US008220384B2

(12) United States Patent
Bosga

(10) Patent No.: US 8,220,384 B2
(45) Date of Patent: Jul. 17, 2012

(54) MOTOR UPGRADE KIT FOR A MECHANICAL PRESS

(75) Inventor: Sjoerd Bosga, Vasteras (SE)

(73) Assignee: ABB Research Ltd. (CH)

( * ) Notice: Subject to any disclaimer, the term of this patent is extended or adjusted under 35 U.S.C. 154(b) by 0 days.

(21) Appl. No.: 12/630,520

(22) Filed: Dec. 3, 2009

(65) Prior Publication Data

US 2010/0089258 A1 Apr. 15, 2010

Related U.S. Application Data

(63) Continuation of application No. PCT/IB2007/001525, filed on Jun. 6, 2007.

(51) Int. Cl.
*B30B 1/26* (2006.01)
*B30B 15/14* (2006.01)

(52) U.S. Cl. ..... 100/282; 100/292; 100/48; 72/429

(58) Field of Classification Search ..... 100/48, 100/273, 280, 282, 283, 291, 292; 72/441, 72/443, 444, 429, 449, 450, 451; 74/15.8, 74/89, 89.25, 572, 572.1
See application file for complete search history.

(56) References Cited

U.S. PATENT DOCUMENTS 4,397,232 A * 8/1983 Schockman et al. ..... 100/214
5,425,682 A * 6/1995 Hayashi ..... 475/5
5,468,194 A 11/1995 Hayashi
5,669,294 A 9/1997 Klemm et al.
6,012,322 A * 1/2000 Itakura ..... 72/450
2002/0017205 A1 2/2002 Metzger et al.
2004/0003729 A1 1/2004 Aoshima
2005/0145117 A1 7/2005 Du et al.

FOREIGN PATENT DOCUMENTS

DE 4421527 A1 12/1995
EP 0941832 A1 9/1999
EP 1628389 A2 2/2006
JP 11058091 A 3/1999

OTHER PUBLICATIONS

International Preliminary Report on Patentability; PCT/IB2007/001525; Oct. 5, 2009; 16 pages.
International Search Report; PCT/IB2007/001525; Jul. 24, 2008; 5 pages.

* cited by examiner

*Primary Examiner* — Jimmy T Nguyen
(74) *Attorney, Agent, or Firm* — St. Onge Steward Johnston & Reens LLC

(57) ABSTRACT

A press drive motor upgrade kit for adapting a mechanical press of the flywheel-driven type to a servo press including a drive motor and a drive train, and a mechanical press so modified. The kit includes at least one servo motor adapted for driving the mechanical press and a drive transmission apparatus or gear transmission or the like, connected to the servo motor and adapted for engagement with at least one gear or shaft of the drive train of said mechanical press. The kit may also include a baseplate or mounting structure on which the servo motor and transmission are arranged.

18 Claims, 2 Drawing Sheets

MOTOR UPGRADE KIT FOR A MECHANICAL PRESS

TECHNICAL FIELD

The invention concerns a conversion apparatus and method for a mechanical press. In particular it describes an electric motor upgrade kit of parts to adapt a mechanical press of the flywheel-driven type and convert it to a servo press. The kit may be advantageously used to convert an existing mechanical press, or a mechanical press being manufactured according to an existing traditional flywheel design, into a servo press, preferably of the hybrid servo type and thus provide greater control over a production cycle of the existing press or press made to a traditional design.

TECHNICAL BACKGROUND

Mechanical presses are commonly used to form industrial products such as automobile parts which are stamped or pressed from steel blanks or workpieces. Today's large mechanical presses are most often driven by a flywheel. The function of the flywheel is to store the necessary energy to carry out a pressing, stamping, punching etc operation. A motor drives the flywheel so that before the start of a press operation the flywheel is rotating at the speed at which the pressing will occur.

In such presses, parts are pressed between an upper and a lower die. The upper die is connected to the press slide, which moves up and down in the slide guides, while the lower die is either fixed or mounted on a bed. The slide motion is driven by the press mechanism, which is located in the upper part of the press, known as the crown. The press mechanism consists of speed-reducing gears and a mechanism which translates rotating motion of the gears into linear motion of the slide. This translation can either be a relatively simple eccentric mechanism, or a more complicated link-drive mechanism. The gears today are driven by the flywheel, which is connected to the so-called main shaft (or high-speed shaft) through a clutch. A brake is also connected to this same shaft.

In a conventional mechanical press the press continues to rotate after each pressing stage is completed until its eccentric wheel has rotated one complete turn. During this second stage following pressing, the motor driving the flywheel will slowly increase the rotational speed and regain the normal pressing speed. At the end of the operation, the clutch is disengaged and a brake is used to stop the motion of the press. In the traditional mechanical solution, press speed is fixed and proportional to flywheel speed during the complete operation. Thus, if pressing has to be done at a low speed (for quality or other technical reasons), the complete operation will occur at low speed. This results in a long cycle time, and therefore, a low production rate. To address the problem of low speeds in the non pressing stage of a press production cycle presses with variable speed drive motors, known as servo presses, or hybrid servo presses, have been developed. For example, US2004/003729, entitled Drive unit and drive method for press, assigned to Komatsu, describes a press drive unit with a first drive system for driving a flywheel with a main motor and a second drive system for driving the drive shaft at variable speed with a sub motor.

To provide a servo press, one option is designing completely new press mechanics, and integrating a servo motor and associated transmission into this new design. This option, a new press design, is the option which can give a design which is best suited for servo operation, as the design can be optimized. For example it can be designed for optimal controllability of the press during the pressing phase, or for highest possible productivity. However, this option has high risks for both press manufacturers and their customers: the design will be new and thus unproven, and most often manufacturers and customers have, as yet, few or no clear specifications for how such a design should perform. As a result, different manufacturers will likely offer very different servo press designs, some slower than existing mechanical presses, some with extremely high power requirements, and in general with very different performances which may be unpredictable over a long service life. Servo presses, such as presses disclosed in U.S. patent application 60/765,183, sometimes described as having a Direct Drive Chain configuration, do not have a large flywheel and a clutch. A servo motor drives the press directly. At the start of the operation, the motor accelerates the press to a high speed, higher than the pressing speed. Then, before impact, the motor slows down the press to pressing speed. Pressing thus occurs at around the same speed as with the mechanical solution. As soon as pressing is completed, the motor once again accelerates the press to high speed. When the press has opened sufficiently for an unloader robot to enter the press, the motor starts slowing down the press. The servo press can thus reach a much improved cycle time at low pressing speeds, because of its capability to run at a high speed during the rest of the cycle. However, the servo press requires a large motor and power converter (approx. five times larger than the fully mechanical press).

SUMMARY OF THE INVENTION

According to an aspect of the present invention a drive motor upgrade kit for adapting a mechanical press of the flywheel-drive is described, which said kit comprises a servo motor adapted for driving said mechanical press and a drive transmission apparatus connected to the servo motor and adapted for engagement with at least one gear or shaft of said drive train of said mechanical press, and a structural fixture or baseplate on which the servo motor and the drive transmission apparatus are arranged.

According to an embodiment of the present invention a drive motor upgrade kit for adapting a mechanical press of the flywheel-drive is described wherein the drive transmission apparatus of said upgrade kit is adapted to cooperate with a gear or shaft of the existing original press drive train.

According to an embodiment of the present invention a drive motor upgrade kit for adapting a mechanical press of the flywheel-drive is described wherein the drive transmission apparatus is mounted on an external part of said mechanical press to cooperate with a gear or shaft of said drive train of said mechanical press arranged inside said mechanical press.

According to another embodiment of the present invention a drive motor upgrade kit for adapting a mechanical press of the flywheel-drive is described wherein the drive transmission apparatus is mounted on an external part of said mechanical press to cooperate with a gear or shaft of said drive train of said mechanical press arranged inside said mechanical press, which gear may be an intermediate gear of the original existing press drive train.

According to another embodiment of the present invention a drive motor upgrade kit for adapting a mechanical press of the flywheel-drive is described wherein the upgrade kit comprises a common fixture or baseplate which is arranged for attaching the servo motor beside or above the crown of said mechanical press for engagement via the drive transmission apparatus with said drive train of said mechanical press.

According to another embodiment of the present invention a drive motor upgrade kit for adapting a mechanical press of the flywheel-drive is described wherein the upgrade kit comprises a common fixture or baseplate which is arranged for attaching the servo motor on top of the crown of said mechanical press.

According to another embodiment of the present invention a drive motor upgrade kit for adapting a mechanical press of the flywheel-drive is described wherein the upgrade kit further comprises a control means for limiting the total peak power, both positive and negative, of the first press flywheel motor and the upgrade motor to a value which is equal to or lower than the peak power of the servo motor alone.

According to another aspect of the present invention a mechanical press for a mechanical press of the flywheel-driven type is disclosed which is arranged with a drive motor upgrade kit for adapting said mechanical press of the flywheel-driven type to a servo press comprising a drive motor and a drive train, such that said mechanical press further comprises a servo motor adapted for driving said mechanical press and a drive transmission apparatus connected to the servo motor and adapted for engagement with at least one gear or shaft of said drive train of said mechanical press and a structural fixture or baseplate on which the servo motor and the drive transmission apparatus are arranged.

An object of this invention is to eliminate the inconveniences of the above mentioned solutions, with a design that:

- can be installed on an existing press in a very short time, on site
- does not require significant modifications in the press crown
- can be offered as an option on a new press, which can be added in a late stage of the press design/manufacturing process
- has a relatively low inertia To realize some of the above objects, the servo motor and associated transmission (gears) are preferably built together as a unit, which is called a "Press Motor Upgrade Kit". This unit is designed to be mounted on top of the press crown, and to connect to the existing press gears without requiring any modification of the existing press mechanism. In this description, the term servo motor is used to mean any type of controllable, variable-output electric motor.

The Press Motor Upgrade Kit is a standalone unit which is mounted on the press in one part. It consists of a base plate, or base structure, which holds together the other parts of the kit, principally a motor and an associated transmission (eg gears). This structure or baseplate is fixed to the top or other structural part of the press crown, with sufficient mounting accuracy and rigidity. On the baseplate or structure is mounted the (servo) motor or motors. Through a coupling this motor is connected to gear wheels of the mechanical press, which gears will typically reduce the speed of the motor to a lower speed of an existing gear in the press crown. This connection will then allow the upgrade motor to move the press gears at variable speed, both in positive and negative direction and up to a higher speed (eg. 50% higher) when not stamping than the maximum stamping speed the mechanical press drive was originally designed for. Another advantage is the increased flexibility of production cycle made possible. For example, the hybrid servo technology described here allows pressing at lower speed while maintaining cycle time, or alternatively pressing at an identical speed but with shorter cycle time, or a mix of these two.

Since the press motor upgrade Kit does not require major modifications in the press crown, installation on an existing press will be quick, and can easily be performed in a planned maintenance or holiday stop of the press. Minor modifications to the crown may include changing top plates, moving ventilation holes, moving eccentric position sensors, moving lubrication tubing, moving or replacing fencing, adding fixture holes, mechanizing part of the crown top structure, adding cable guides for the servo motor cabling, etc. However minor modifications such as these can be performed on site, and also do not affect the existing gear mechanism of the press.

Application of the kit is not limited to presses in which a pinion of the main shaft is close enough to the exterior of the press to interact with a gear of the kit. In fact, in most presses the main shaft is not at all close to the top of the crown. Instead, in most presses there are intermediate gears close to the top of the crown. These intermediate gears are used to provide a gear step between the high speed of the main shaft and the low speed of the eccentric wheels of a traditional mechanical press.

Thus, in its most typical form the Press Upgrade Kit will preferably be designed to interact with an intermediate gear of the existing mechanical press, since this gear is almost always closest to the top of the press crown (in a some cases it may even extend to above the top of the crown structure). It may seem a disadvantage that such an intermediate gear rotates at a lower speed than the main shaft, since a higher gear ratio is thus required in the transmission to a high-speed motor. However, to bridge the distance between the top of the intermediate gear wheel and the mounting point of a first gear wheel belonging to the kit, typically a relatively large-diameter gear wheel is needed. To limit the kinetic energy associated with such a wheel, it is advantageous that it turns at as low speed as possible. Thus, for a kit to add as little inertia to the press as possible, interfacing with an intermediate gear is in most cases preferable to interfacing with a main-shaft pinion.

An important advantage of using the described motor upgrade kit to adapt a press is that relying on an existing press design means that established design rules still apply, so that there should be no unpleasant surprises in press performance, life time, etc. Thus reliability for an adapted press is expected to be high. Yet another advantage of using the described motor upgrade kit is that it does not involve any structural changes in the existing press or press design. This represents a simpler process which takes relatively little time, so that time down time is comparatively short. The absence of structural changes made to the existing press also means that using the press motor upgrade kit involves a lower risk to the manufacturer than investing in a whole new press design. In addition, it is also an advantage that in a hybrid topology, the Kit can be removed if necessary after which the manufacturer has a fully functional traditional mechanical press.

The invention may be applied extensively, because adding a servo motor to an existing design is an option which can be applied to existing presses. Since presses typically have a life time of more than 30 years, this is a very important advantage. Many manufacturers and suppliers seek to upgrade or refurbish their existing press lines rather than investing in completely new lines.

As an alternative, a kit may be designed to interact with a gear associated with an eccentric wheel of the press (requiring a higher gear ratio to be realized in the kit) or a main-shaft pinion (or gear) (requiring a lower gear ratio to be realized in the kit).

In other embodiments additional gear mechanisms between the servo motor of the kit and the existing gear transmission system of the mechanical press may be used. For example, between the servo motor and the gear that interconnects with the existing drive train there may be more than a gear or gears, there may be a belt drive or chain drive as well.

In further embodiments or developments the transmission between the servo motor of the kit and the existing press may also comprise a clutch. A brake 40 may also be added between the servo motor and the existing press gears, to work as a brake 40 on the servo motor drive and transmission. Such a brake 40 may optionally be arranged connected to the upgrade motor (22) for braking it or holding it at standstill. A clutch and a brake may optionally be combined into a single unit, interspersed between the servo motor and the existing transmission gears of the press.

In another aspect of the invention, a press system or press line comprising at least one mechanical press of the flywheel-driven type arranged with a drive motor upgrade kit and the press operated synchronised with loading and/or press unloading equipment is described.

BRIEF DESCRIPTION OF THE DRAWINGS

Embodiments of the invention will now be described, by way of example only, with particular reference to the accompanying drawings in which.

DETAILED DESCRIPTION OF THE EMBODIMENTS

Figure 1:
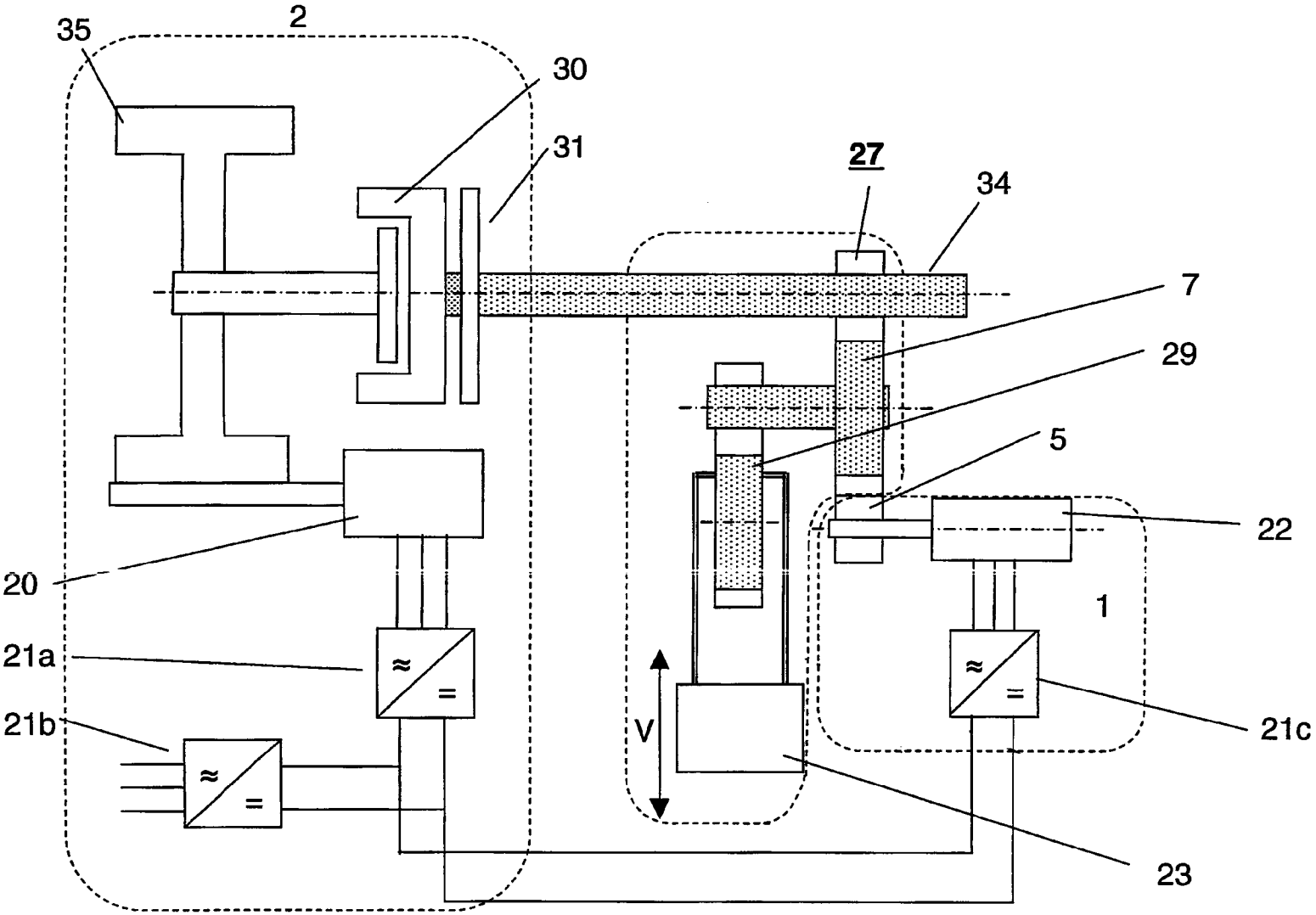
FIG. 1 is a schematic block diagram for a motor upgrade kit for a mechanical press, according to an embodiment of the invention.

FIG. 1 shows the topology of a mechanical press with two drives: a mechanical drive 2 comprising a clutch 30 and flywheel 35, with associated motor 20, and a servo motor 22 with associated transmission 5. The figure also shows a press ram 23 which is driven in a reciprocal motion V by a main shaft 34 via press transmission gears 27 and an eccentric wheel 29 and to open and close the press 23.

With both drives, existing motor 20 and upgrade motor 22 in operation this is the topology of a hybrid servo press. With only the mechanical drive in place or operating, this would be a classic mechanical press. With only the motor upgrade Kit 1 operating, (and, possibly, an emergency brake), this would be a "full" servo press. However, the most likely topology for a mechanical press comprising the motor upgrade kit is the hybrid servo topology.

Figures 2A, 2B:
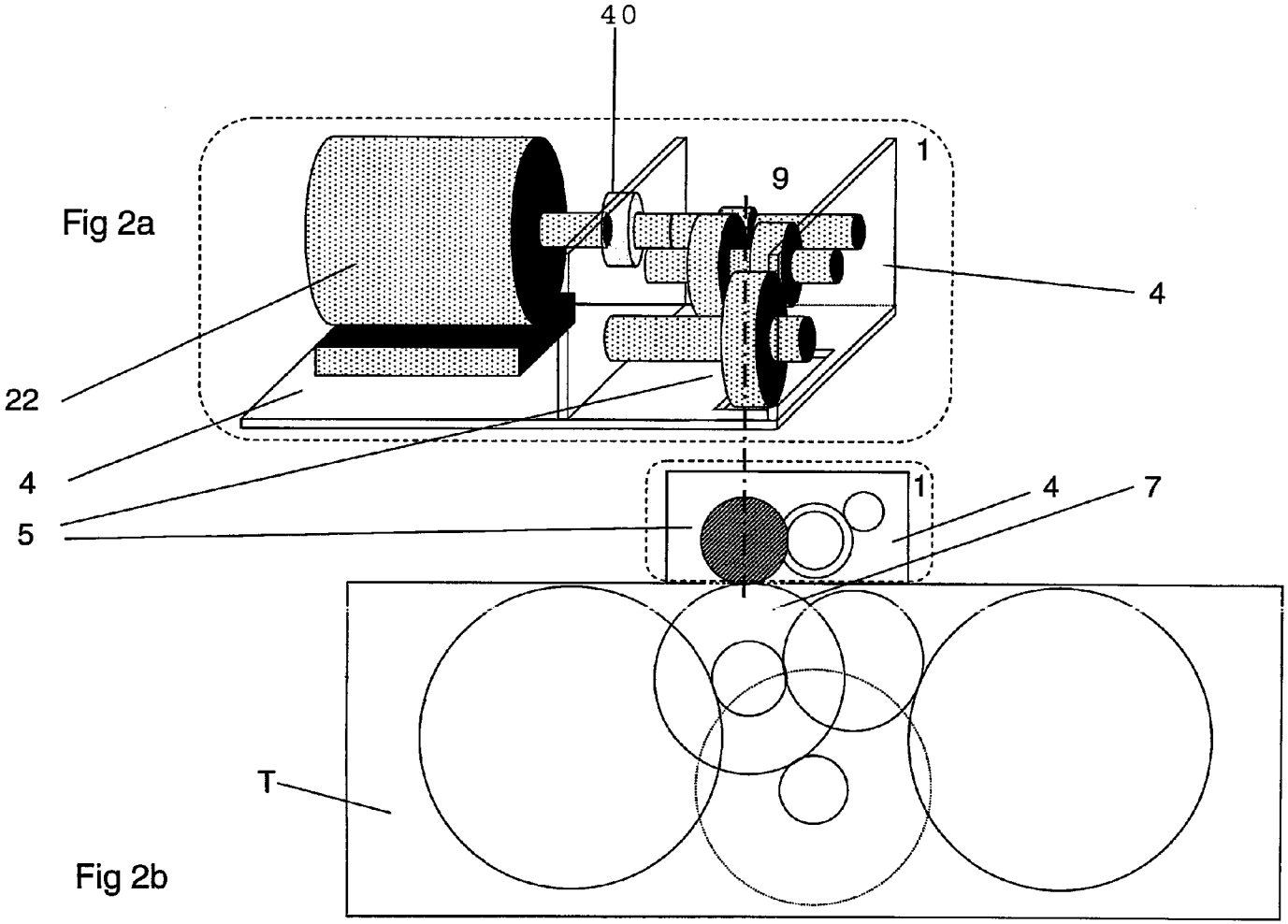
FIG. 2*a* is a schematic diagram showing a perspective view of a motor upgrade kit for a mechanical press, according to an embodiment of the invention.
FIG. 2*b* is a schematic diagram comprising a view of the crown part of a mechanical press as a front elevation together with the relative position of a motor upgrade kit, according to an embodiment of the invention.

FIG. 2*a* shows a principle drawing of a kit 1 with a single motor, as well as a schematic diagram of how the kit would interact with the gears of a press in FIG. 2*b*. FIG. 2*a* shows the motor upgrade motor 22 mounted on a structural baseplate 4, to which is also attached a set of gears 9 for transmitting power from the motor 22. FIG. 2*b* shows a diagram of the crown or top T of a mechanical press. The figure shows the kit 1, with the upgrade motor 22 and a set of gears 9 arranged on a baseplate 4. The kit is shown here arranged on top of the crown of the press such that a gear 5 (FIG. 1) of the set of gears 9 of the kit 1 is arranged to cooperate with a gear 7 (FIG. 1) of the existing power transmission train of the mechanical press so that the upgrade motor 22 can drive the press through the existing power train of the press.

When operating a press adapted with the press upgrade kit 1 in a hybrid configuration the clutch and the brake 31 of the press are required to be separately controlled. The brake would normally be activated for emergency braking and maintenance only, while the clutch will be activated during every press cycle, during the actual stamping or pressing. In a traditional mechanical press, clutch and brake may be combined into a unit in which at any time either the clutch or the brake is activated. In a press for which this is the case, the transformation into a servo press requires not only the installation of the Kit, but also a modification in the clutch/brake unit. Either such a combined clutch/brake unit could be modified, or replaced by a new single unit, or replaced by a separate clutch unit and a brake unit.

The gears of the Press Upgrade Kit may, for the hybrid servo press topology, typically be narrower, or thinner than the existing press gears. This is possible because the kit gears do not need to be dimensioned for the full pressing force, since this force will continue to be supplied by the flywheel. Thus, by using a smaller width, ie thickness of the gear wheel, the kit will be more compact and add less inertia to the press.

The above discussion regarding gear ratios applies to the case where a (servo) motor is used which has a higher top speed than the desired top speed of the main shaft. Future motor developments may lead to the use of a lower-speed motor, making a connection to intermediate gears or even eccentric-shaft gears even more appropriate.

A servo motor such as motor 22 to be added to an existing press or press design typically has a top speed which is higher or not much lower than the top speed of the main shaft 34 of the traditional press. Thus the connection of this servo motor would typically include a gearing transmission mechanism 5 between the motor shaft and the press main shaft. Different solutions for such a transmission mechanism exist, among which may be:

1. adding a gear wheel to the main shaft, which interacts with a gear wheel on the upgrade motor shaft, possibly with intermediate gear wheels; 2. adding a pulley to the main shaft, which through a belt is connected to a smaller pulley, which is mounted on the motor shaft, possibly with intermediate gear wheels; 3. adding a pinion to the main shaft, through which a chain is connected to a smaller pinion, which is mounted on the motor shaft, possibly with intermediate gear wheels;

All these solutions have in common a drawback that a modification has to be made inside the crown T of the press. An exception would be that a new gear, pulley or pinion were mounted on the mainshaft and on the outside of the crown, but this would typically mean that the main shaft has to be made longer—thus also affecting an existing component which is inside the crown.

Solutions 2 and 3 (belt or chain transmission) above are relatively easy to realise, since only a single wheel (pulley or pinion) has to be mounted on the main shaft. However, both chains and belts usually have a limited lifetime and limited capability for power transmission, which make their application in presses limited and difficult. For example, a belt for a 1000 T hybrid servo press would have a width of about 300 mm, which is large compared to available space, and would have a lifetime of less than three years. Mounting and/or replacing a belt inside a press would also be complicated, unless the pulley were at the end of the shaft, since the belt has "infinite length". Furthermore, both the belt and the pulley solution require a wheel on the main shaft of such diameter, strength and width, that a significant increase in the total inertia of rotating masses (>=15%) would result, so deteriorating the dynamic performance of the servo solution. In the case of the chain, even the mass of the chain would add significant inertia.

However, solutions 2 and 3 have the important advantage that a large distance between main shaft and servo motor can be bridged through the belt or the chain, and that the required gear ratio between main shaft and servo motor shaft may then be realized in a single step. Since a large distance can be bridged, the servo motor can be mounted at the top of the press. This means that this solution can be realized for most constructions of a press—provided that an suitable location is found for a pulley on the main shaft.

Solution 1 does not have this advantage—bridging the distance between the main shaft and the top of the press is difficult, and would involve large gear wheels with correspondingly large inertia. The main problem with this solution is however that the new gear wheels also require support for their bearings. These supports would either have to be made in the existing crown structure, or a supporting plate or structure would have to be added and fixed to the crown.

Furthermore, these solutions have the following inconveniences:

for a new press:

modifications in the crown design have to be done early in the design stage of the press for an existing press:

modifications in the crown require moving the press (crown) to a specialized workshop (solution 1)

modifications in the crown will leave the press inoperable for a long time (for solution 1 this may be around 2 months, which is more than the usual 1-month summer break)

solutions 2 and 3 add much inertia to the press, which may mean that the press brake must be re-dimensioned (i.e. replaced by a bigger brake)

for new and existing presses:

solutions 2 and 3 add much inertia to the press, thus limiting the performance improvement the servo should give.

Thus with the upgrade kit according to the present invention the inconveniences of the above mentioned solutions are eliminated by means of the described design that:

can be installed on an existing press in a very short time, on site does not require significant modifications in the press crown can be offered as an option on a new press, which can be added in a late stage of the press design/manufacturing process has a relatively low inertia.

A press that has been upgrade may be arranged with a control unit 21*c* to control the new motor. A control unit 21*b* may also be arranged to control both motors. A control unit or control system 21*a-c* may also be arranged to control the existing or new motor of the flywheel and its existing or new inverter to limit the total peak power (both positive and negative) of the two motors (20, 22) to a value which is equal to or lower than the peak power of the servo motor, using the flywheel as an energy buffer.

The motor speed control means may comprise a frequency converter, an inverter/rectifier as shown or other motor speed control means. Motor speed control means may also be shared with other presses or machines. The drive may be a multidrive, i.e. a system where two or more inverters share a single rectifier. This is advantageous for the case where due to the above mentioned power limitation the peak power of the rectifier is lower than or equal to the peak power of the inverter for the servo motor. Preferably in arrangements of an upgrade press with which the flywheel is NOT used for pressing (i.e. when run not a hybrid servo but a direct/full servo), the flywheel may STILL be used for the above mentioned power limitation.

The rectifier is in any case preferably arranged to be bi-directional, so that energy can be fed back to the grid. Since the rectifier is an active rectifier, it can supply reactive power to the factory grid. It may thus be used to compensate for some of the reactive power consumed by rectifiers used in other presses. Possible configurations include:

existing flywheel motor, inverter, rectifier maintained existing flywheel motor, inverter, rectifier replaced, rectifier shared with servo drive (this allows maximum peak power limitation)

existing motor maintained, but inverter and rectifier replaced (almost same as previous, if motor is AC motor)

An advantage of a hybrid servo or direct servo press is that it may be synchronised with other equipment. For such a press, or a press converted with the press motor upgrade kit herein described that may be controlled with variable speed, there are ways to adapt the motion of the press so that the press is synchronized to the motion of the unloader and/or loader robot, resulting in optimal cycle times. This and other methods are described in a PCT application filed on Jun. 6, 2007 entitled IMPROVED METHOD AND SYSTEM FOR OPERATING A CYCLIC PRODUCTION MACHINE IN COORDINATION WITH A LOADER OR UNLOADER MACHINE, filed by the same applicant as this application, and with an inventor in common, which application is hereby included in this specification by means of this reference. The described method comprises changing setpoints in the press motion depending on an estimated synchronization time point. The described invention also provides a method for automatically optimizing the press line while in operation. Also, proposed methods are described that may be used for synchronizing the unloader robot to the press as well. To optimise the productivity of press lines and/or servo press line, motion of the presses should be synchronized to the motion of the loading equipment and vice versa. Especially for the reversing ("alternative bi-directional") motion, this requires a new concept for synchronization, different from what has been used for traditional mechanical presses. A press line may comprise a number of presses, usually arranged to carry out a sequence of operations. The term "press line" may also include a single press and a mechanised loader and/or unloader.

The servo motor may be controlled to run according to different strategies for different types of press cycle. For example higher than pressing speed before and after pressing, in order to reduce cycle time AND/OR maintain cycle time but reduce pressing speed.

In addition, line coordination of an entire process section may be improved by controlling such a line using a single controller arranged to carry out methods according to an embodiment of the invention, due in part to the improved controllability of the direct servo or hybrid servo presses. This may be carried out by a robot controller unit and/or by another control unit. Coordination or optimisation may be achieved in part by adapting speed during opening/closing a press (while for example maintaining a required speed and energy output during the pressing/stamping part of the cycle), resulting in cycle times which may be reduced dependent on parameters such as: a state of a downstream process; or a state of an upstream process or another consideration such as overall power consumption; reduced energy consumption; smoothing power consumption peaks in the press line.

It should be noted that while the above describes exemplifying embodiments of the invention, there are several variations and modifications which may be made to the disclosed solution without departing from the scope of the present invention as defined in the appended claims.

The invention claimed is:

1. A drive motor upgrade kit for adapting a mechanical press of a flywheel-driven type to a servo press, said mechanical press having a drive motor and an existing drive train, said kit comprising:

a servo motor adapted for driving said mechanical press, a drive transmission apparatus connected to the servo motor and adapted for engagement with at least one gear of said existing drive train of said mechanical press, which engagement requires no modification of said existing drive train, a baseplate for fixing to a structural part of said mechanical press, the baseplate having an opening, at least one vertical wall, and at least one baseplate gear, wherein the servo motor and the drive transmission apparatus are mounted on the baseplate, wherein the servo motor and drive transmission apparatus are separated by the at least one vertical wall of the baseplate, wherein the baseplate is fixed to top of a crown of the mechanical press, wherein the at least one baseplate gear cooperates with the at least one gear of the existing drive train of said mechanical press through the opening in the baseplate to engage the drive transmission apparatus with said existing drive train of said mechanical press, wherein the servo motor moves the at least one gear at a variable speed, both in a positive and negative direction, and wherein the kit is removable from said mechanical press after which said mechanical press is fully functional.

2. The kit of claim 1, wherein the servo motor and the drive transmission apparatus are arranged on said baseplate for mounting the baseplate on an external part of said mechanical press and so connecting the servomotor via the drive transmission apparatus to a part of the said existing drive train of said mechanical press.

3. The kit of claim 1, further comprising a brake is connected between the servo motor and the existing drive train of the mechanical press for braking the servo motor.

4. The kit of claim 1, further comprising a clutch connected between the servo motor and said existing drive train of said mechanical press.

5. The kit of claim 1, further comprising a clutch and brake connected between the servo motor and said existing drive train of said mechanical press, said clutch and brake unit being arranged for mechanically switching out the servo motor so that the press can be run without the servo motor providing power, and said clutch and brake unit being combined into a single unit.

6. The kit of claim 1, further comprising two or more servo motors in the upgrade kit.

7. The kit of claim 1, further comprising a control system having a power supply connected thereto for controlling the function of the servo motor.

8. The kit of claim 1, further comprising a control suitable for limiting the total peak power, both positive and negative, of the first motor and the upgrade motor to a value which is equal to or lower than the peak power of the servo motor alone.

9. The kit of claim 1, further comprising a power supply with a connection to one inverter or at least two inverters connected to a single rectifier and a control unit or control system arranged suitable for control of the motor of the flywheel and its existing or new inverter to limit the total peak power, both positive and negative, of the two motors to a value which is equal to or rower than the peak power of the servo motor, using the flywheel as an energy buffer.

10. An apparatus, comprising:

a mechanical press of a flywheel-driven type comprising a drive motor and a drive train;

a drive motor upgrade kit comprising:

a servo motor adapted for driving said mechanical press;

a drive transmission apparatus connected to the servo motor;

a baseplate having an opening and at least one baseplate gear;

wherein the servo motor and the drive transmission apparatus are mounted on the baseplate;

wherein the at least one baseplate gear cooperates with at least one gear of said mechanical press drive train through the opening in the baseplate to engage the drive transmission apparatus with said mechanical press drive train;

wherein the servo motor moves the at least one gear at a variable speed, both in a positive and negative direction;

wherein said baseplate is fixed to a structural part of said mechanical press, wherein the baseplate is fixed to top of a crown of the mechanical press for engagement of the drive transmission apparatus with said drive train of said mechanical press, and wherein the kit is removable from said mechanical press after which said mechanical press is fully functional.

11. The apparatus of claim 10, further comprising a control system having a power supply connected thereto for controlling the function of the servo motor of the upgrade kit.

12. The apparatus of claim 10, characterized by being arranged for control by a control unit which is any from the group of: a robot controller, a press PLC.

13. A method for converting a mechanical press of a flywheel driven type to a servo press, said mechanical press comprising a drive motor and an existing drive train, comprising the steps of:

providing a mechanical press of a flywheel driven type, the mechanical press having a drive motor and a drive train;

providing a drive motor upgrade kit, the drive motor upgrade kit having a servo motor adapted for driving said mechanical press, a drive transmission apparatus connected to the servo motor, a baseplate having an opening and at least one baseplate gear, wherein the servo motor and the drive transmission apparatus are mounted on the baseplate, wherein the baseplate is fixed to top of a crown of the mechanical press, wherein the at least one baseplate gear cooperates with at least one gear of said existing drive train of said mechanical press through the opening in the baseplate to engage the drive transmission apparatus with said existing drive train of said mechanical press, wherein the servo motor moves the at least one gear at a variable speed, both in a positive and negative direction;

fixing said or baseplate to a crown of said mechanical press;

engaging the at least one baseplate gear with said mechanical press drive train, wherein the drive motor upgrade kit is removable from said mechanical press after which said mechanical press is fully functional.

14. The method of claim 13, further comprising the step of:

arranging said mechanical press for control and operation as a direct servo press wherein the flywheel is not used during operation.

15. The method of claim 13, further comprising the steps of forming metal or plastic components.

16. The kit of claim 1, wherein installation of the kit on said mechanical press is does not affect an existing gear mechanism of said press.

17. The kit of claim 1, wherein the least one gear is an inter-mediate gear.

18. A drive motor upgrade kit for adapting a mechanical press of the flywheel-driven type to a servo press, said mechanical press comprising a drive motor and an existing drive train, said kit consisting of:

a servo motor adapted for driving said mechanical press, a drive transmission apparatus connected to the servo motor and adapted for engagement with at least one gear of said existing drive train of said mechanical press, which engagement requires no modification of said existing drive train, a baseplate for fixing to a structural part of a press, the baseplate having an opening, wherein the servo motor and the drive transmission apparatus are mounted on the baseplate, wherein the baseplate is fixed to top of a crown of the mechanical press for engagement of the drive transmission apparatus with said existing drive train of said mechanical press through the opening in the baseplate, and wherein the servo motor moves the at least one gear at a variable speed, both in a positive and negative direction, wherein the kit is removable from said mechanical press after which said mechanical press is fully functional.

* * * * *